US008395562B2

(12) United States Patent
Hsu et al.

(10) Patent No.: US 8,395,562 B2
(45) Date of Patent: Mar. 12, 2013

(54) ANTENNA MODULE FOR PORTABLE ELECTRONIC DEVICE

(75) Inventors: Cho-Kang Hsu, Tu-Cheng (TW); Yi-Ting Chen, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 352 days.

(21) Appl. No.: 12/844,989

(22) Filed: Jul. 28, 2010

(65) Prior Publication Data

US 2011/0291906 A1 Dec. 1, 2011

(30) Foreign Application Priority Data

May 25, 2010 (TW) ..... 99116597

(51) Int. Cl.
*H01Q 9/26* (2006.01)

(52) U.S. Cl. ..... 343/803; 343/793; 343/866

(58) Field of Classification Search ..... 343/793–795, 343/866, 842
See application file for complete search history.

(56) References Cited

U.S. PATENT DOCUMENTS

| | | | | |
|---|---|---|---|---|
| 5,198,826 | A * | 3/1993 | Ito | 343/726 |
| 7,583,235 | B2 * | 9/2009 | Kim et al. | 343/803 |
| 8,207,899 | B2 * | 6/2012 | Ishimiya | 343/702 |
| 2010/0103064 | A1 * | 4/2010 | Yang et al. | 343/793 |

* cited by examiner

*Primary Examiner* — James H Cho
(74) *Attorney, Agent, or Firm* — Altis Law Group, Inc.

(57) ABSTRACT

An antenna module for a portable electronic device includes a loop portion, a dipole portion, a feeding end portion and a grounding end portion. The dipole portion is positioned in the loop portion and connected to the loop portion. The feeding end portion and the grounding end portion are connected to the loop portion.

16 Claims, 7 Drawing Sheets

ANTENNA MODULE FOR PORTABLE ELECTRONIC DEVICE

BACKGROUND

1. Technical Field

The disclosure generally relates to antenna modules, particularly to a miniaturized antenna module and a portable electronic device using the antenna module.

2. Description of Related Art

Antennas are usually assembled inside a portable electronic device to send and receive signals. The antennas often occupy a large amount of space within the portable electronic device.

Therefore, there is room for improvement within the art.

BRIEF DESCRIPTION OF THE DRAWINGS

Many aspects of the antenna module for portable electronic device can be better understood with reference to the following drawings. The components in the drawings are not necessarily drawn to scale, the emphasis instead being placed upon clearly illustrating the principles of the antenna module for the portable electronic device.

DETAILED DESCRIPTION

Figure 1:
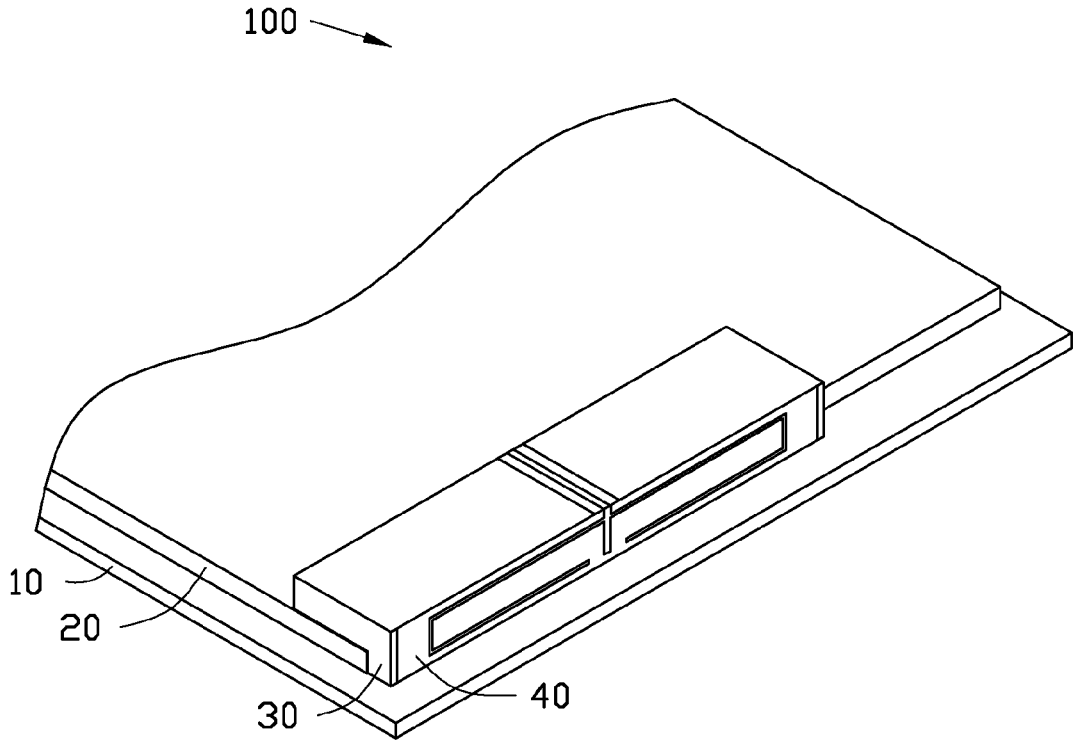
FIG. 1 is partially, schematic view of a portable electronic device employed with an antenna module, according to one exemplary embodiment.
Figure 2:
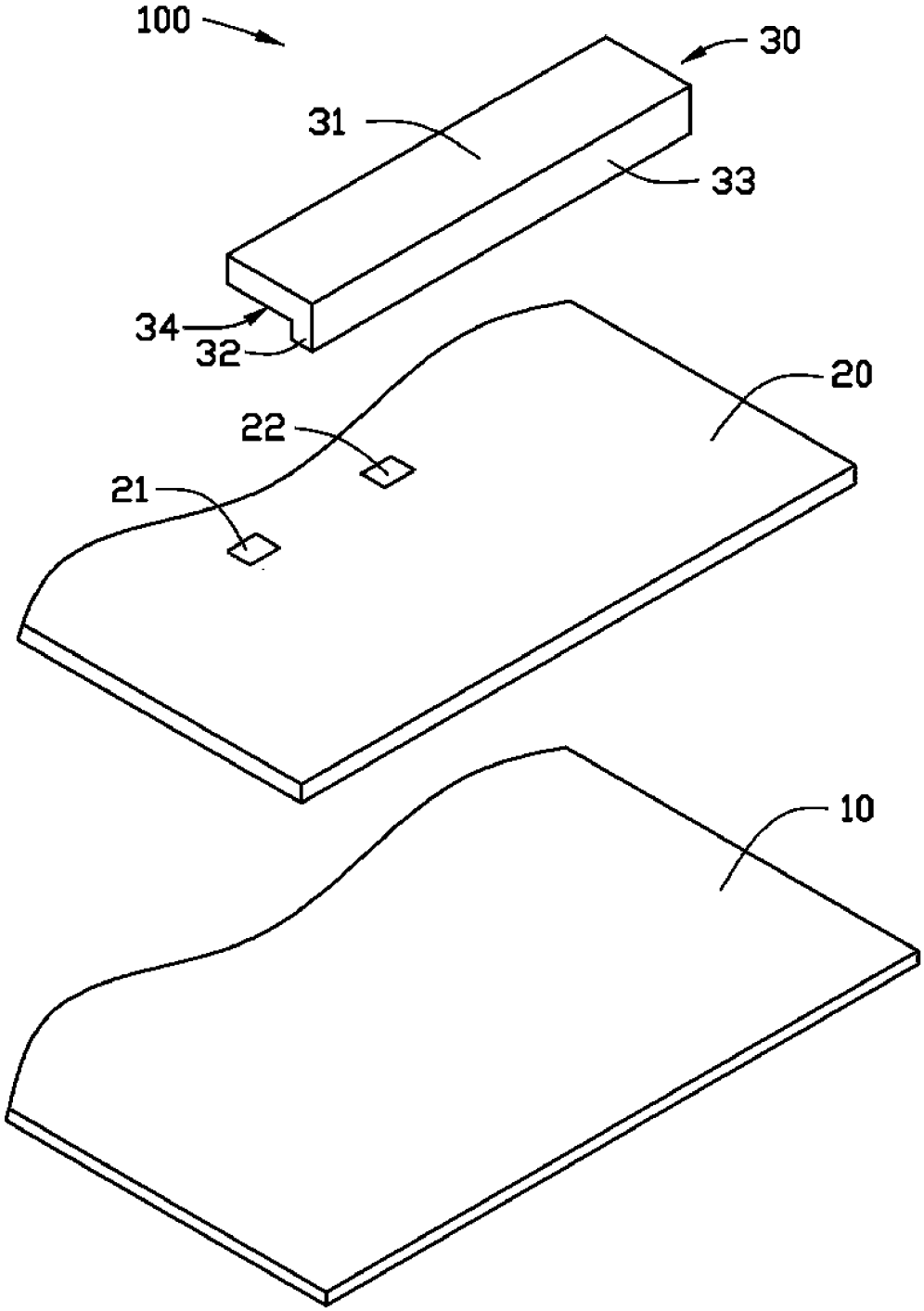
FIG. 2 is an exploded view of the portable electronic device of FIG. 1.

FIGS. 1 and 2 show an exemplary embodiment of a portable electronic device 100 such as a mobile phone and a personal digital assistant (PDA) including a housing 10 (partially shown), a circuit board 20 (partially shown), a substrate 30 and an antenna module 40. The circuit board 20 and the substrate 30 are mounted inside the housing 10. The antenna module 40 is attached to the substrate 30 and connected to the circuit board 20.

The housing 10 can be a portion of a cover of the portable electronic device 100. The circuit board 20 is mounted inside the housing 10 and includes a feeding point 21 (schematically shown) and a grounding point 22 (schematically shown). The substrate 30 includes a top surface 31, a bottom surface 32 and a side surface 33. The bottom of the substrate 30 is recessed to form a stepped mounting surface 34.

Figure 3:
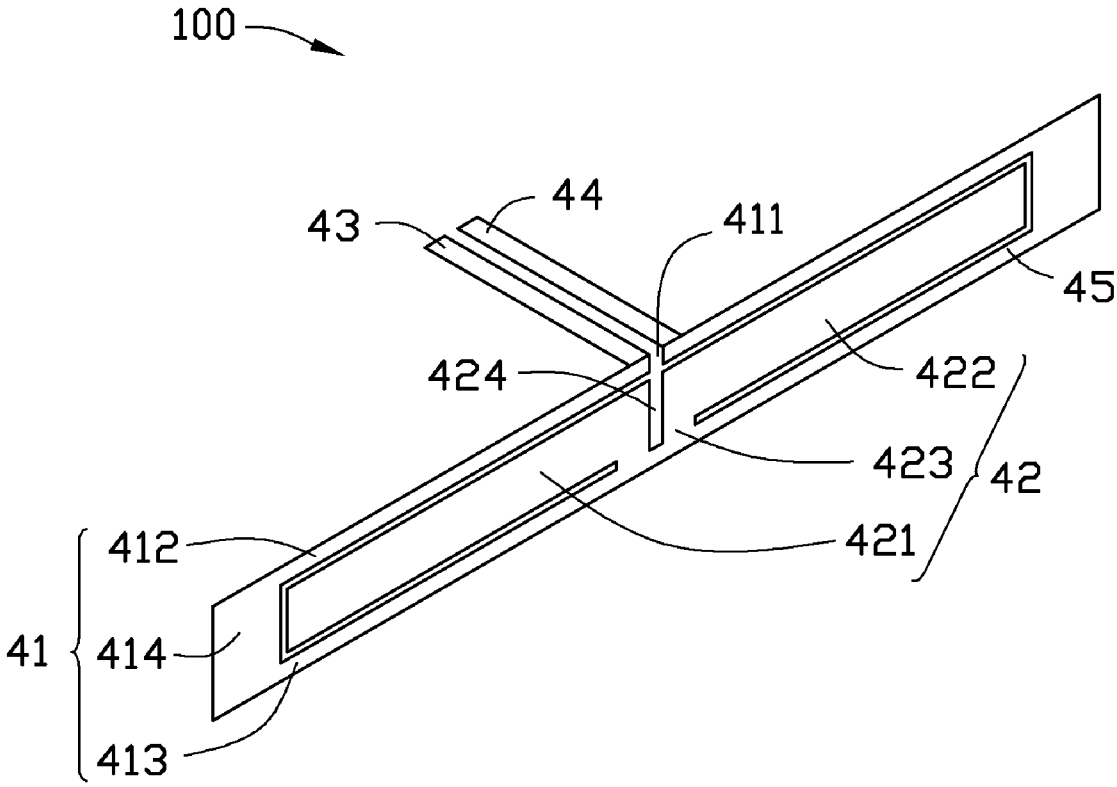
FIG. 3 is a schematic view of the antenna module of FIG. 1.

Referring to FIG. 3, the antenna module 40 includes a loop portion 41, a dipole portion 42, a feeding end portion 43 and a grounding end portion 44. The loop portion 41 is substantially a rectangular frame having an opening 411. The loop portion 41 includes a first radiating section 412, a second radiating section 413, and two connecting sections 414. The second radiating section 413 has substantially the same length and width as the first radiating section 412. The first and second radiating section 412 and 413 are parallel with each other. The two connecting sections 414 connect to ends of the first and second radiating section 412, 413 and form the frame loop portion 40 with the first and second radiating section 412, 413. The opening 411 is defined in a middle portion of the first radiating section 412.

The dipole portion 42 includes a first radiating arm 421, a second radiating arm 422, and two connecting ends 423. The length and width of the first and second radiating arm 421 are the same as that of the second radiating arm 422 in this exemplary embodiment. The first radiating arm 421 and the second radiating arm 422 are arranged in a line and cooperatively define a slot 424 therebetween. The two connecting ends 423 are positioned at one side of the first and second radiating arm 421, 422. Each connecting end 423 is connected to one of the first and second radiating arm 421, 422.

The dipole portion 42 is positioned in the loop portion 41. Two distal ends of the connecting ends 423 opposite to the first and second radiating arm 421, 422 are connected to the second radiating section 413 of the loop portion 41. The slot 424 communicates with the opening 411. The length of each of the first and second arms 421, 422 is slightly less than ½ the length of the first radiating section 412; the width of the first and second arms 421, 422 is slightly less than the width of the connecting ends 414. Therefore, two substantially U-shaped gaps 45 are formed between the loop portion 41 and the dipole portion 42.

Figure 4:
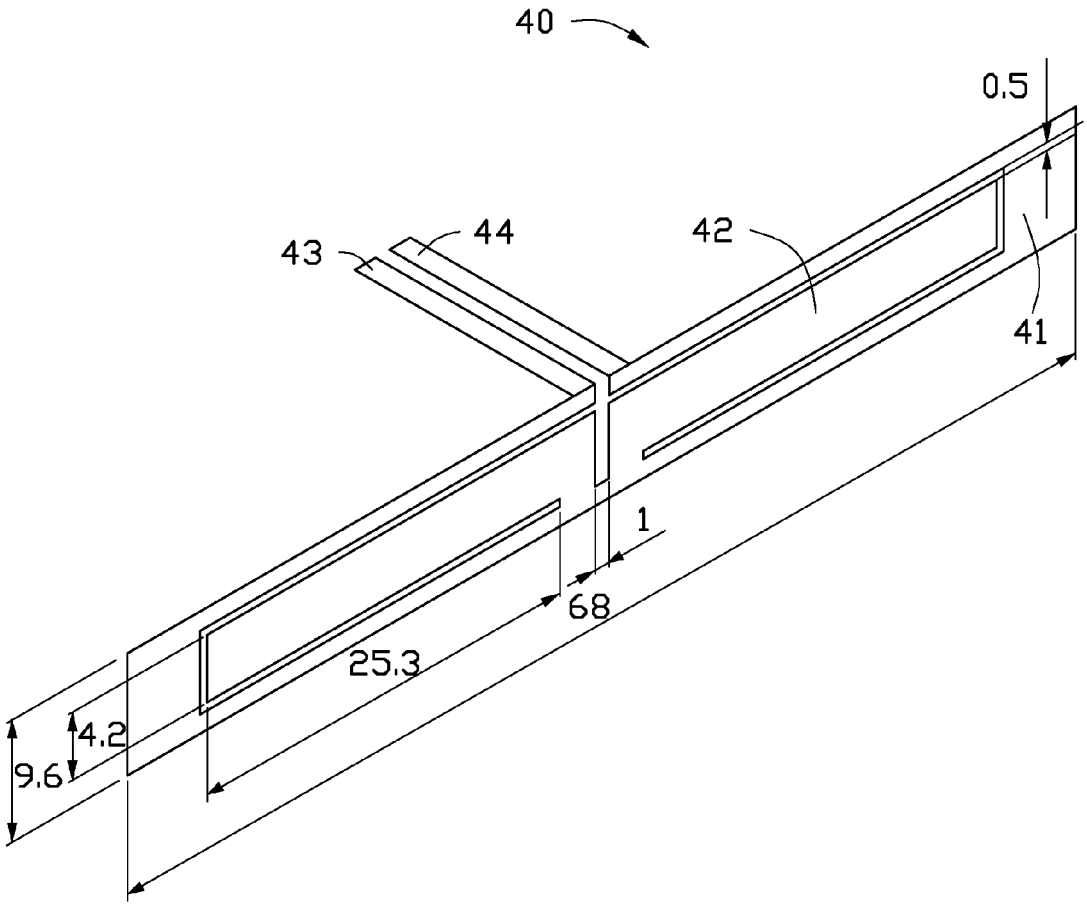
FIG. 4 is a schematic view of exemplary dimensions of an exemplary embodiment of the antenna module of FIG. 1.

Referring to FIG. 4, in an exemplary embodiment, the length and width of the loop portion 41 are 68 mm and 9.6 mm, respectively. The length and width of the first and second radiating arm are 25.3 mm and 4.2 mm, respectively. The width of the gap 45 between the dipole portion 42 and loop portion 41 is 0.5 mm. The width of the slot 424 and the opening 411 is 1 mm.

The feeding end portion 43 and the grounding end portion 43 are both rectangular sheets connecting to the feeding point 21 and the grounding point 22 of the circuit board 20, respectively.

To assemble the portable electronic device 100, the circuit board 20 and the substrate 30 are mounted inside the housing 10. The mounting surface 34 of the substrate 30 is attached to the circuit board 20 and supported by the circuit board 20. The antenna module 40 is mounted on the substrate 30. The feeding end portion 43 and the grounding end portion 44 are attached on the top surface 31 and respectively connected to the feeding point 21 and the grounding point 22. The loop portion 41 and the dipole portion 42 are attached on the side surface 32.

Figure 5:
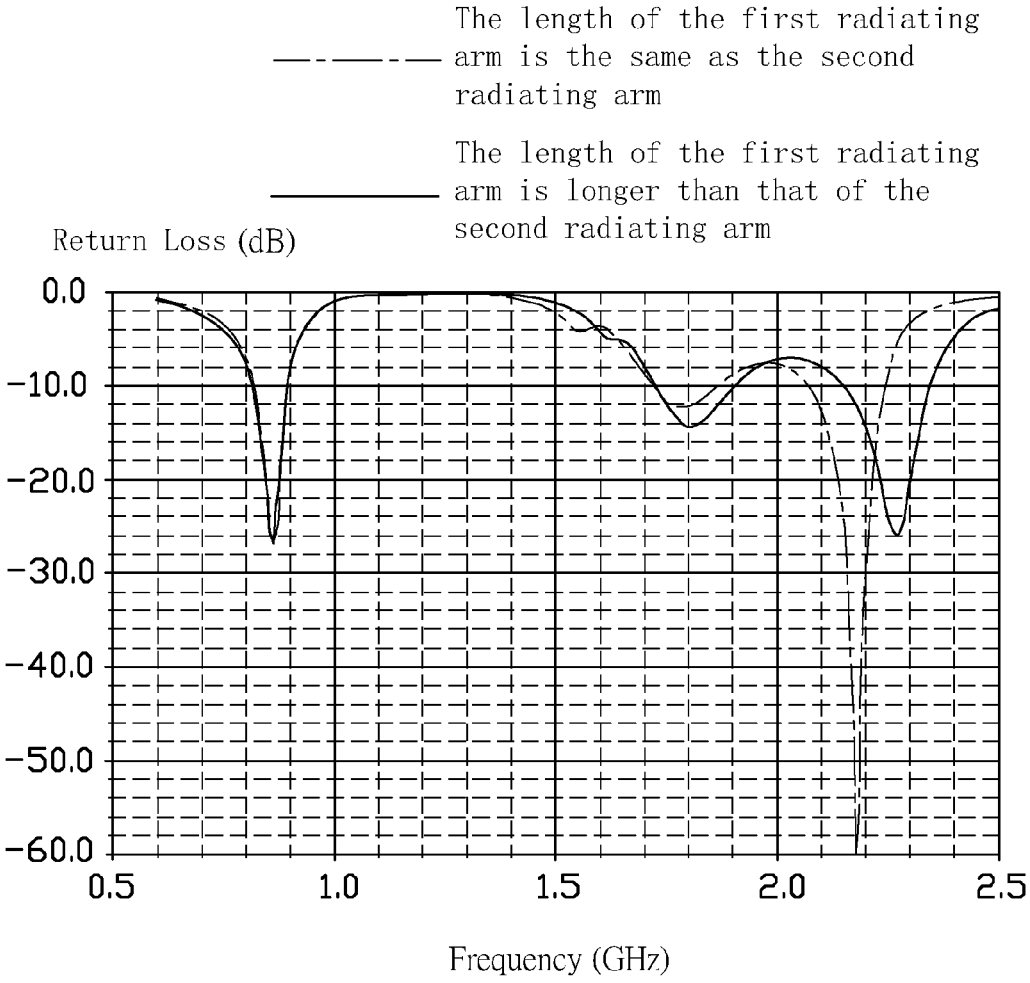
FIG. 5 is a test graph obtained from the antenna module of FIG. 1, disclosing return loss varying with frequency, when the lengths of the first and second radiating arm are changed.

Referring to FIG. 5, the portable electronic device 100 may work at a first frequency band of about 824 MHz-894 MHz and a second frequency band of about 1710 MHz-2170 MHz, which are suitable for different communication systems. In addition, to adjust the second frequency band of the antenna module 40, the length of the first radiating arm 421 and the second radiating arm 422 can be changed, such as the length of the first radiating arm 421 can be made slightly longer than the length of the second radiating arm 422.

Figure 6:
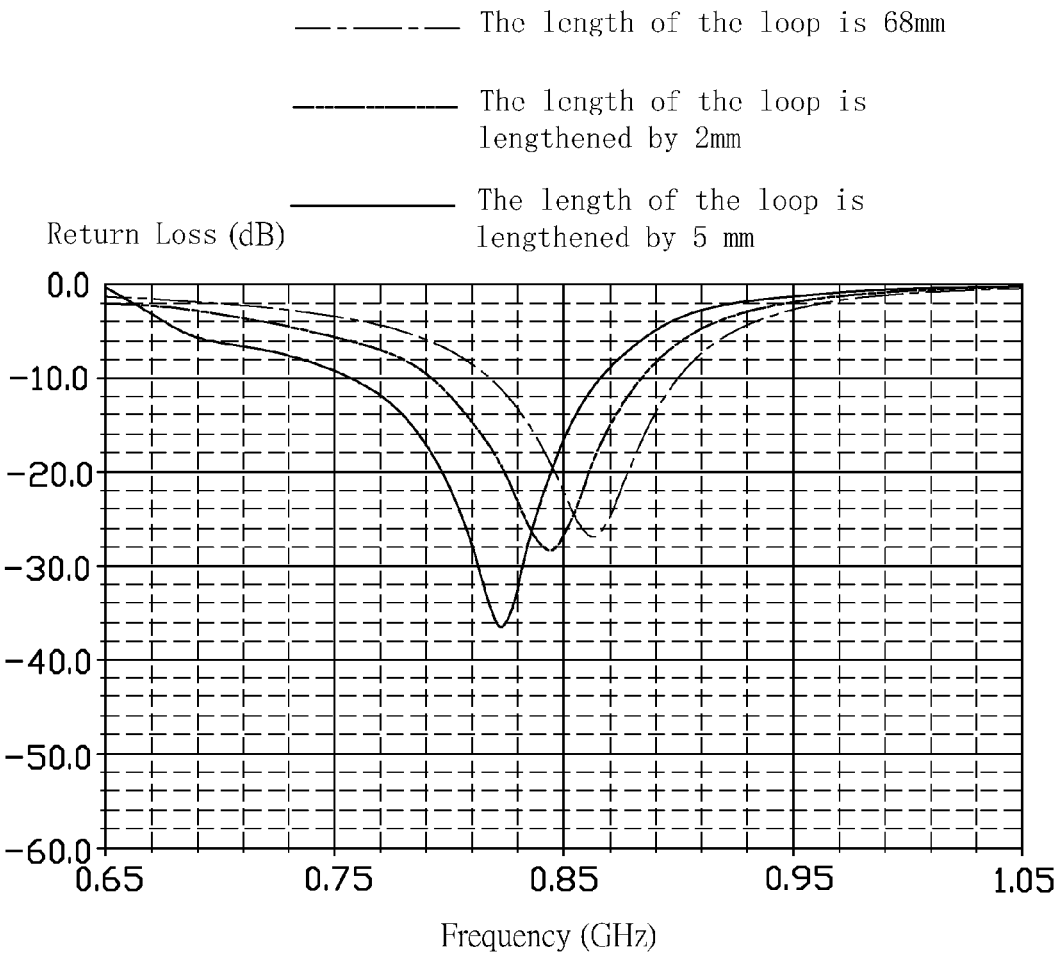
FIG. 6 is a test graph obtained from the antenna module of FIG. 1, disclosing return loss varying with frequency, when the length of the loop portion is lengthened.

Referring to FIG. 6, to adjust the first frequency band of the antenna module 40, the length of the loop portion 41 can be changed. For example, when the length of the first radiating section 412 and the second radiating section 413 is lengthened by 2 mm, the center of the first frequency band is adjusted from about 860 MHz to about 830 MHz; when the length of the first radiating section 412 and the second radiating section 413 are lengthened by 5 mm, the center of the first frequency band is adjusted from about 860 MHz to about 810 MHz.

Figure 7:
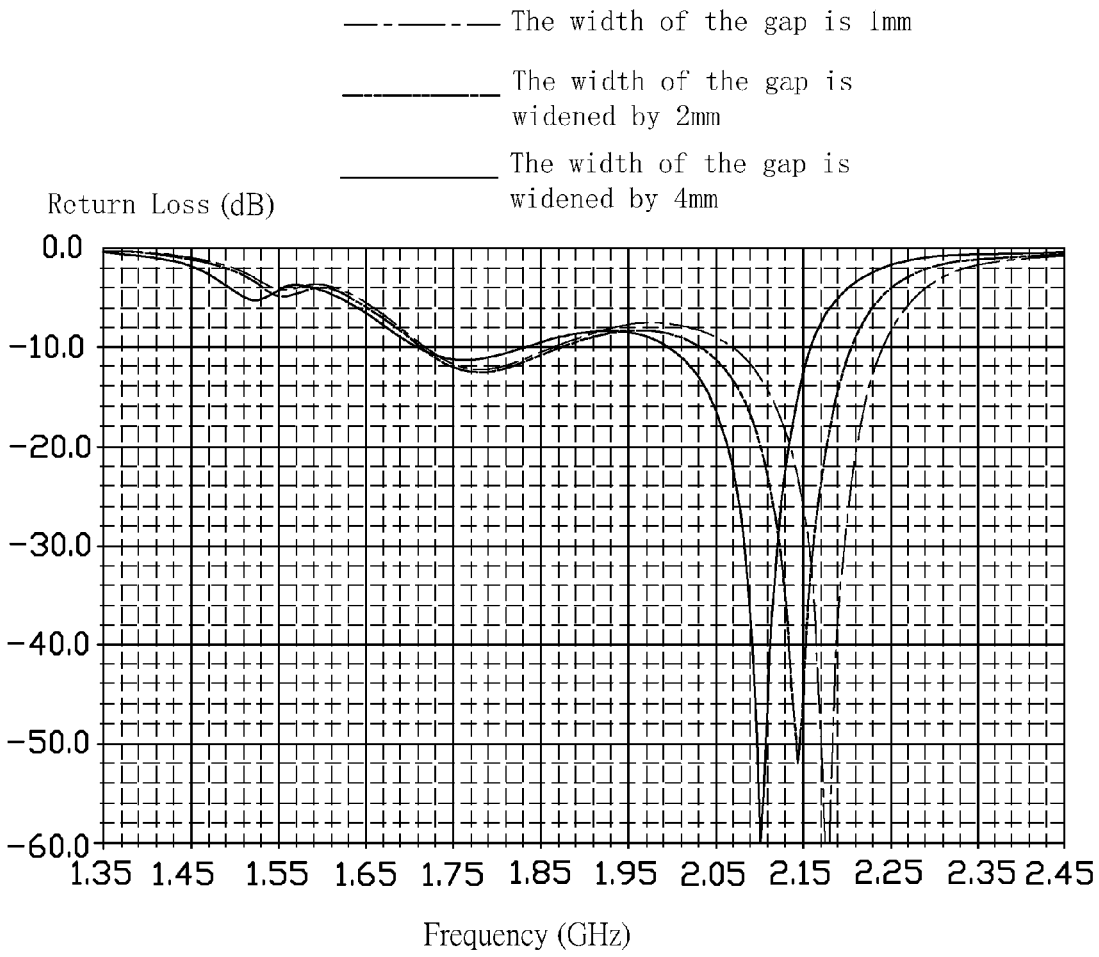
FIG. 7 is a test graph obtained from the antenna module of FIG. 1, disclosing return loss varying with frequency, when width of the gap is widened.

Referring to FIG. 7, the width of the slot 424 between the first radiating arm 421 and the second radiating arm 422 can be changed to adjust the second frequency band of the antenna module 40. For example, when the width of the slot 424 is widened by 2 mm, the center of the second frequency band is adjusted from about 2170 MHz to about 2014 MHz;

when the width of the slot 424 is widened by 4 mm, the center of the second frequency band is adjusted from about 2170 MHz to about 2090 MHz.

The antenna module 40 with the combination of the loop portion 41 and the dipole portion 42 are miniaturized, having the first and second frequency bands for different communication systems.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna module for a portable electronic device, comprising:

a loop portion that is substantially a rectangular frame with an opening, the loop portion comprising a first radiating section defining the opening, a second radiating section opposite and parallel to the first radiating section, and two opposite and parallel connecting sections, the connecting sections interconnecting the first radiating section and the second radiating section;

a dipole portion positioned in the loop portion and connected to the second radiating section of the loop portion; and a feeding end portion and a grounding end portion both connected to the first radiating section of the loop portion.

2. The antenna module as claimed in claim 1, wherein the loop portion and the dipole portion define two gaps therebetween.

3. The antenna module as claimed in claim 2, wherein each gap is substantially U-shaped.

4. The antenna module as claimed in claim 1, wherein the dipole portion includes a first radiating arm, a second radiating arm and two connecting ends; the first radiating arm and the second radiating arm are collinear and define a slot therebetween, a first end of each connecting end connects to one of the first and second radiating arms, a second end of each connecting end connects to the second radiating section.

5. The antenna module as claimed in claim 4, wherein the slot communicates with the opening.

6. A portable electronic device, comprising:

a housing;

a circuit board including a feeding point and a grounding point mounted on the housing;

a substrate mounted on the housing and supported by the circuit board; and an antenna module mounted on the substrate; comprising:

a loop portion that is substantially a rectangular frame with an opening, the loop portion comprising a first radiating section defining the opening, a second radiating section opposite and parallel to the first radiating section, and two opposite and parallel connecting sections, the connecting sections interconnecting the first radiating section and the second radiating section;

a dipole portion positioned in the loop portion and connected to the second radiating section of the loop portion; and a feeding end portion and a grounding end portion both connected to the first radiating section of the loop portion and respectively connected to the feeding point and the grounding point.

7. The portable electronic device as claimed in claim 6, wherein the substrate includes a top surface, a bottom surface opposite to top surface, a side surface connecting to the top surface and the bottom surface and a stepped mounting surface recessed from the bottom surface; the mounting surface is attached to the circuit board and supported by the circuit board; the feeding end portion and the grounding end portion are attached on the top surface; the loop portion and the dipole portion are attached on the side surface.

8. The portable electronic device as claimed in claim 6, wherein the loop portion and the dipole portion define two gaps therebetween.

9. The portable electronic device as claimed in claim 8, wherein each gap is substantially U-shaped.

10. The portable electronic device as claimed in claim 9, wherein the dipole portion includes a first radiating arm, a second radiating arm and two connecting ends; the first radiating arm and the second radiating arm are collinear and define a slot therebetween, a first end of each connecting end connects to one of the first and second radiating arms, a second end of each connecting end connects to the second radiating section.

11. The portable electronic device as claimed in claim 10, wherein the slot communicates with the opening.

12. A portable electronic device, comprising:

a housing;

a circuit board including a feeding point and a grounding point mounted on the housing;

a substrate mounted on the housing and supported by the circuit board, the substrate comprising:

a top surface;

a bottom surface opposite to top surface;

a side surface connecting to the top surface and the bottom surface; and a stepped mounting surface recessed from the bottom surface, the mounting surface attached to the circuit board and supported by the circuit board; and an antenna module mounted on the substrate; comprising:

a loop portion attached on the side surface;

a dipole portion positioned in the loop portion and connected to the loop portion, the dipole portion attached on the side surface; and a feeding end portion and a grounding end portion both connected to the loop portion and respectively connected to the feeding point and the grounding point, the feeding end portion and the grounding end portion attached on the top surface.

13. The portable electronic device as claimed in claim 12, wherein the loop portion is substantially a rectangular frame with an opening.

14. The portable electronic device as claimed in claim 13, wherein the loop portion comprises a first radiating section defining the opening, a second radiating section opposite and parallel to the first radiating section, and two opposite and parallel connecting sections, the connecting sections interconnect the first radiating section and the second radiating section.

15. The portable electronic device as claimed in claim 14, wherein the dipole portion includes a first radiating arm, a second radiating arm and two connecting ends; the first radiating arm and the second radiating arm are collinear and define a slot therebetween, a first end of each connecting end connects to one of the first and second radiating arms, a second end of each connecting end connects to the second radiating section.

16. The portable electronic device as claimed in claim 15, wherein the slot communicates with the opening.

* * * * *